US007047995B2

(12) United States Patent
Huang

(10) Patent No.: US 7,047,995 B2
(45) **Date of Patent: *May 23, 2006**

(54) GAS VALVE SWITCH STRUCTURE OF GAS STOVE

(75) Inventor: Chin-Ying Huang, Taichung (TW)

(73) Assignee: HNI Technologies Inc., Muscatine, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/788,751

(22) Filed: Feb. 27, 2004

(65) Prior Publication Data

Related U.S. Application Data

(63) Continuation of application No. 10/364,288, filed on Feb. 10, 2003, now Pat. No. 6,840,261, which is a continuation of application No. 09/755,316, filed on Dec. 29, 2000, now Pat. No. 6,520,199.

(51) Int. Cl.
*F16K 27/00* (2006.01)

(52) U.S. Cl. ..... 137/66; 137/881; 431/59

(58) Field of Classification Search ..... 137/66, 137/881, 65; 431/59, 54
See application file for complete search history.

(56) References Cited

U.S. PATENT DOCUMENTS 3,999,932 A 12/1976 Matthews
5,447,287 A 9/1995 Kelly et al.
6,029,705 A 2/2000 Happe
6,520,199 B1 2/2003 Huang
6,537,058 B1 3/2003 Evans et al.

OTHER PUBLICATIONS

Robertshaw Controls Company; 2000 DER/IPER Gas Heating Controls; 4 Pages.
Robertshaw Controls Company; 2500 DER Gas Heating Control; 4 Pages.
Robertshaw Controls Company; 7000 LC Gas Heating Control; 4 Pages.
Robertshaw Controls Company; 2000 WIPER/WDER Gas Heating Controls; 4 Pages.

*Primary Examiner*—Kevin Lee
(74) *Attorney, Agent, or Firm*—Faegre & Benson LLP

(57) ABSTRACT

A gas valve switch structure of a gas stove includes a top base, an aluminum plate, a sealing washer, two rubber washers, two fixing pieces, a female base, and a protective plate. The protective plate is used for sealing the rubber washer and the fixing piece in the oblong hole of the female base. Then, the top base is screwed on the female base, with the aluminum plate and the sealing washer being clamped between the top base and the female base. The air storing chambers of the female base are closed while the rubber washer and the fixing piece are sealed in the oblong hole of the female base by provision of the aluminum plate and the sealing washer, and the gas valve switch structure of the gas stove achieves a gas triple safety switch by provision of the two electromtagnetic valves and the control bolt.

24 Claims, 8 Drawing Sheets

GAS VALVE SWITCH STRUCTURE OF GAS STOVE

This application is a continuation of application Ser. No. 10/364,288, filed on Feb. 10, 2003, now U.S. Pat. No. 6,840,261 which is a continuation of application Ser. No. 09/755,316, filed on Dec. 29, 2000, issued as U.S. Pat. No. 6,520,199.

BACKGROUND OF THE INVENTION

1. Field of the Invention

The present invention relates to a gas valve switch structure of a gas stove.

2. Description of the Related Prior Art

The closest prior art of which the applicant is aware is disclosed in the Taiwanese Patent Publication No. 273879, entitled by "Gas Switch Device of a Water Heater", which discloses two magnetic members that are mounted in a water disk to actuate a transmission member so that the transmission member is deflected. The deflected transmission member drives a valve rod to displace linearly to open a hole which is used to control the valve.

However, such a conventional switch device has the following disadvantages.

1. The magnetic capacity of the magnetic member easily reduces during long-term utilization, so that the valve cannot be closed completely, thereby affecting the safety of use.

2. The two magnetic members are easily displaced during operation, so that the two magnetic members are not aligned with each other, thereby reducing the magnetic capacity, so that the valve cannot be closed completely.

3. The closing action of the magnetic member is easily affected by other iron members, so that the valve cannot be closed completely.

SUMMARY OF THE INVENTION

The primary objective of the present invention is to provide a gas valve switch structure of a gas stove, wherein two electromagnetic valves are used to control upper and lower fixing pieces, thereby controlling input and output of gas, so as to achieve an electrical double safety switch.

Another objective of the present invention is to provide a gas valve switch structure of a gas stove, wherein a control bolt is used to control input of gas into a female base, thereby achieving a manually operated safety switch.

A further objective of the present invention is to provide a gas valve switch structure of a gas stove, wherein the top base has a pressure outlet hole and a pressure inlet hole for detecting pressure of inlet gas and outlet gas thereby facilitating adjusting the pressure of gas.

A further objective of the present invention is to provide a gas valve switch structure of a gas stove, wherein the female base has two sides each defining a side hole for fitting a warming stove with different outlet directions.

In accordance with one aspect of the present intention, there is provided a gas valve switch structure of a gas stove comprising: a top base, an aluminum plate, a sealing washer, two rubber washers, two fixing pieces, a female base, and a protective plate, wherein, the top base, is substantially rectangular, and has a bottom defining an oblong hole, the oblong hole having a bottom defining an air draining hole, the top base having an upper end integrally defining two through holes, and a pressure outlet hole and a pressure inlet hole located between the two through holes, the two through holes each respectively fitted with a female fire electromagnetic valve and a main fire electromagnetic valve, the main fire electromagnetic valve having a top provided with a pressure regulating knob, the female fire electromagnetic valve being used to control movement of the fixing piece which is located above the female base, the main fire electromagnetic valve being used to control movement of the fixing piece which is located under the top base, the pressure outlet hole and the pressure inlet hole each respectively screwed with a belt;

the aluminum plate, is a rectangular piece, and has a center defining an air draining hole, the air draining hole having one side defining a rectangular hole and a plurality of circular holes;

the sealing washer, is a rectangular piece, and has a center defining an air draining hole, the air draining hole having one side defining a rectangular hole and a plurality of circular holes;

the rubber washer, is an oblong piece, and has a center integrally formed with a fixing bolt, and two ends each defining an air outlet hole, and a periphery defining a plurality of draining holes;

the fixing piece, is an oblong disk, and has a center defining a locking hole, and two ends each defining an air outlet hole;

the female base, is substantially rectangular, and has an inner portion integrally formed with a plurality rib walls for separating the inner portion into a first air storing chamber, a second air storing chamber, and a third air storing chamber, the female base having one side defining a female fire air outlet hole and a main fire air outlet hole, and the other side defining a fixing hole and an air inlet hole, and having two ends each defining a side hole, the first air storing chamber communicating with the air inlet hole, the inner portion of the female base defining a channel so that the second air storing chamber communicates with the female fire air outlet hole, the female base having a bottom defining an oblong hole, the oblong hole having a bottom defining an air draining hole, a control bolt passing through the fixing hole, the control bolt having one end with a semi-cylindrical shape, and the other end fitted with a washer, and having a tail end screwed with a wrench, an air pressure valve secured in the first air storing chamber, the air pressure valve being a piece having a center provided with a protruding knob, and the semi-cylindrical end of the control bolt rested on a lower end of the air pressure valve;

the protective plate, is substantially rectangular, and has a center defining an oblong hole, the oblong bole having a center defining a circular recess;

wherein, the oblong holes of the top base and the female base each respectively receive a rubber washer, thereby closing the oblong hole by the rubber washer, the fixing bolt of the rubber washer is fitted with a fixing piece, the fixing piece defines a circular recess for receiving a spring, so that the fixing piece may be displaced on the fixing bolt, then the protective plate is used for sealing the rubber washer and the fixing piece in the oblong hole of the female base, then the top base is screwed on a top of the female base, with the aluminum plate and the sealing washer being clamped between the top base and the female base, the plurality of air storing chambers of the female base are closed while the rubber washer and the fixing piece of the top base are sealed in the oblong hole of the female base by provision of the aluminum plate and the sealing washer, and the gas valve switch structure of the gas stove achieves a gas triple safety switch by provision of the two electromagnetic valves and the control bolt.

Further benefits and advantages of the present invention will become apparent after a careful reading of the detailed description with appropriate reference to the accompanying drawings.

DETAILED DESCRIPTION OF THE INVENTION

Figure 1:
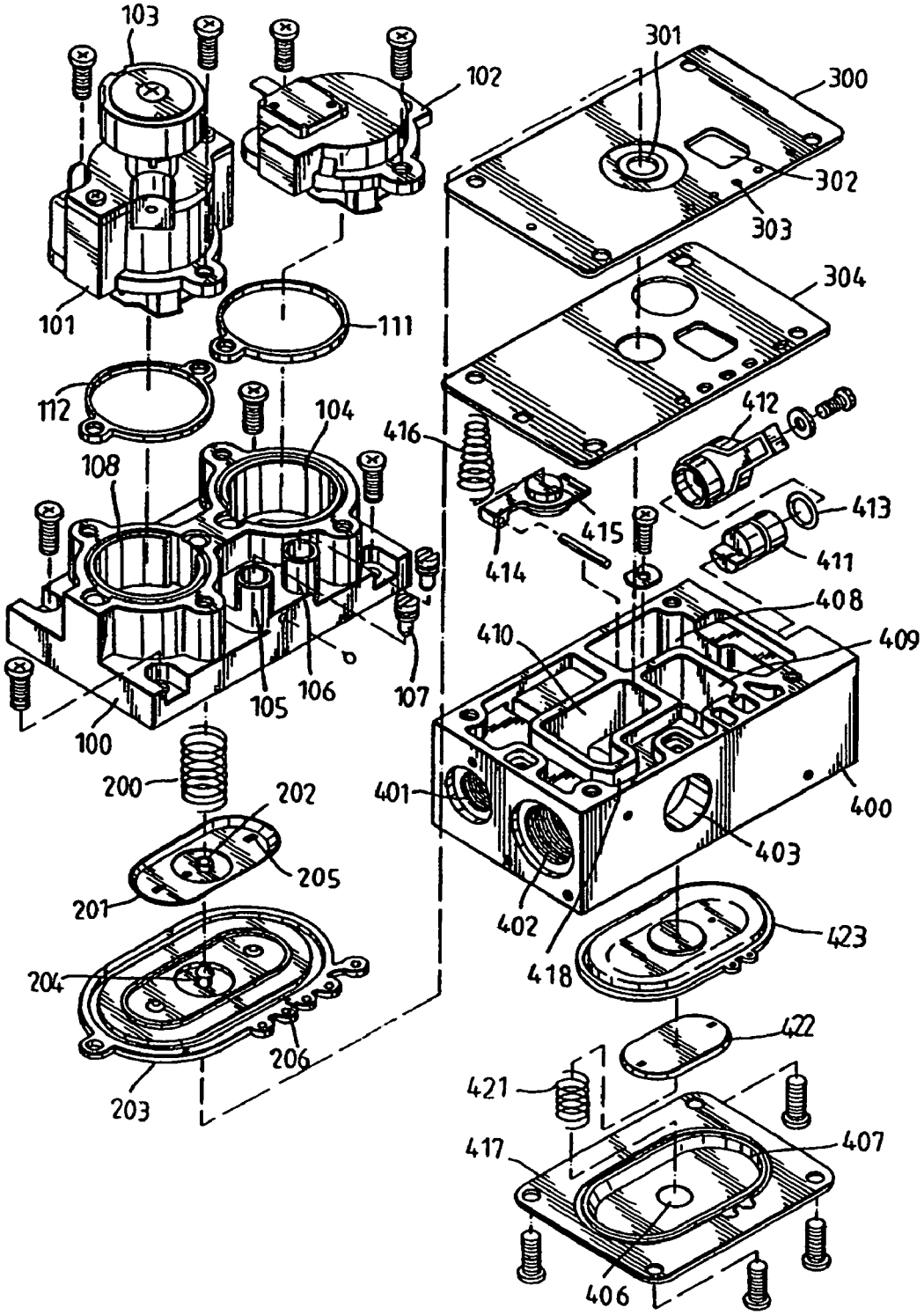
FIG. 1 is an exploded perspective view of a gas valve switch structure of a gas stove in accordance with the present invention.
Figure 2:
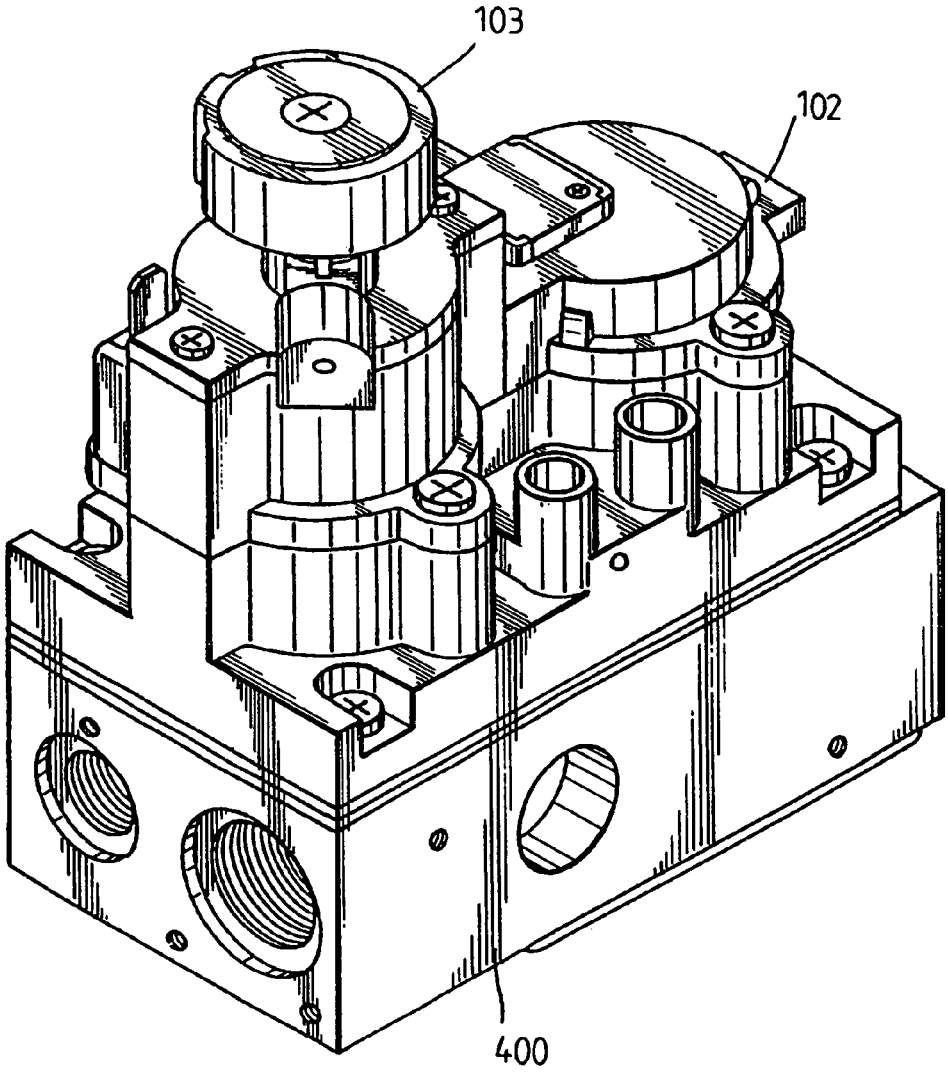
FIG. 2 is a perspective assembly view of the gas valve switch structure of a gas stove as shown in FIG. 1.
Figure 3:
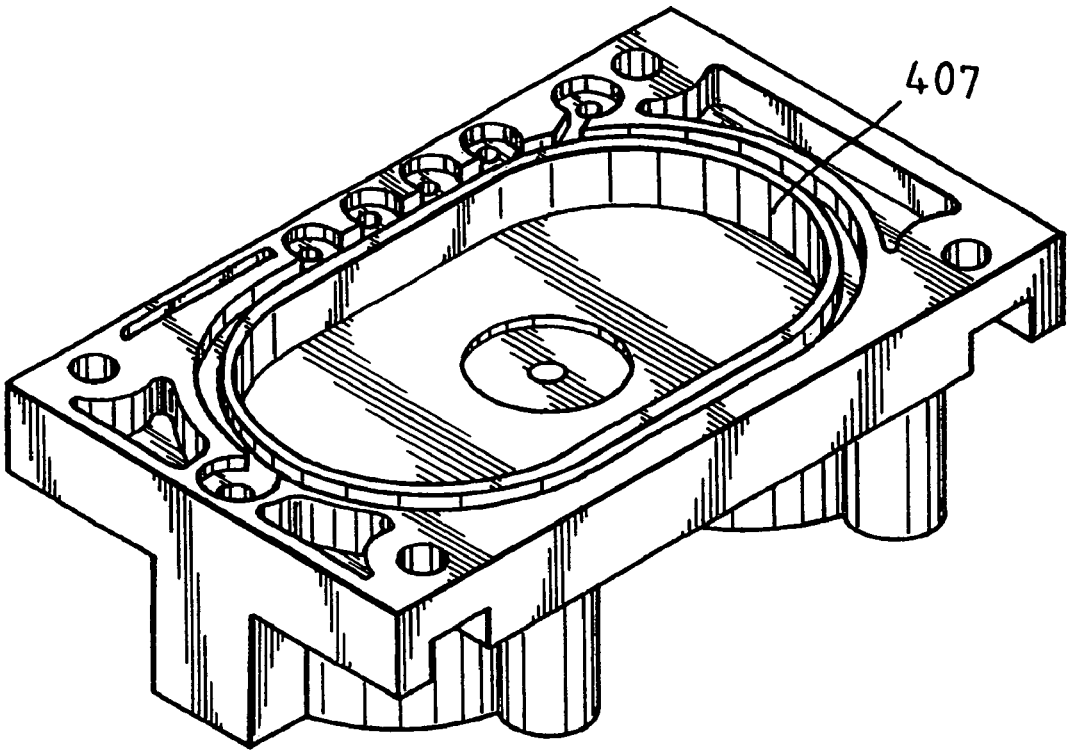
FIG. 3 is a bottom perspective view of a top base of the gas valve switch structure of a gas stove as shown in FIG. 1.
Figure 4:
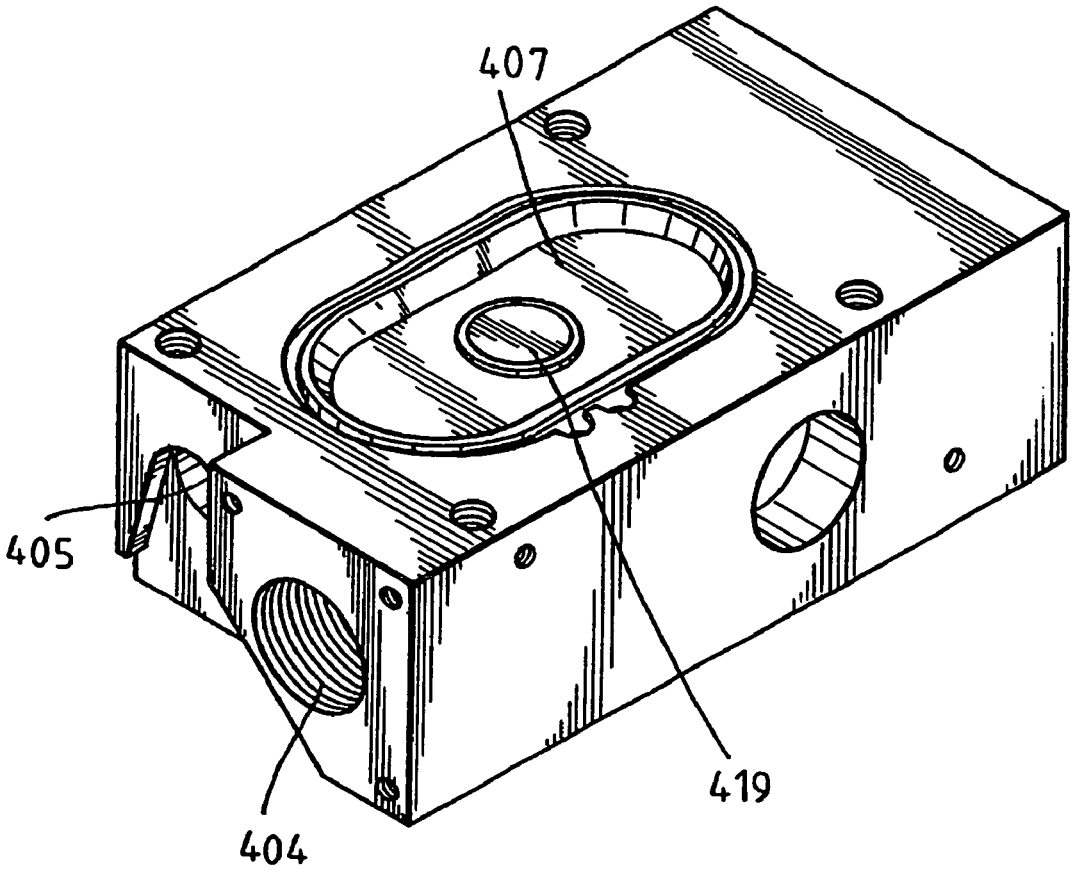
FIG. 4 is a bottom perspective view of a female base of the gas valve switch structure of a gas stove as shown in FIG. 1.
Figure 5:
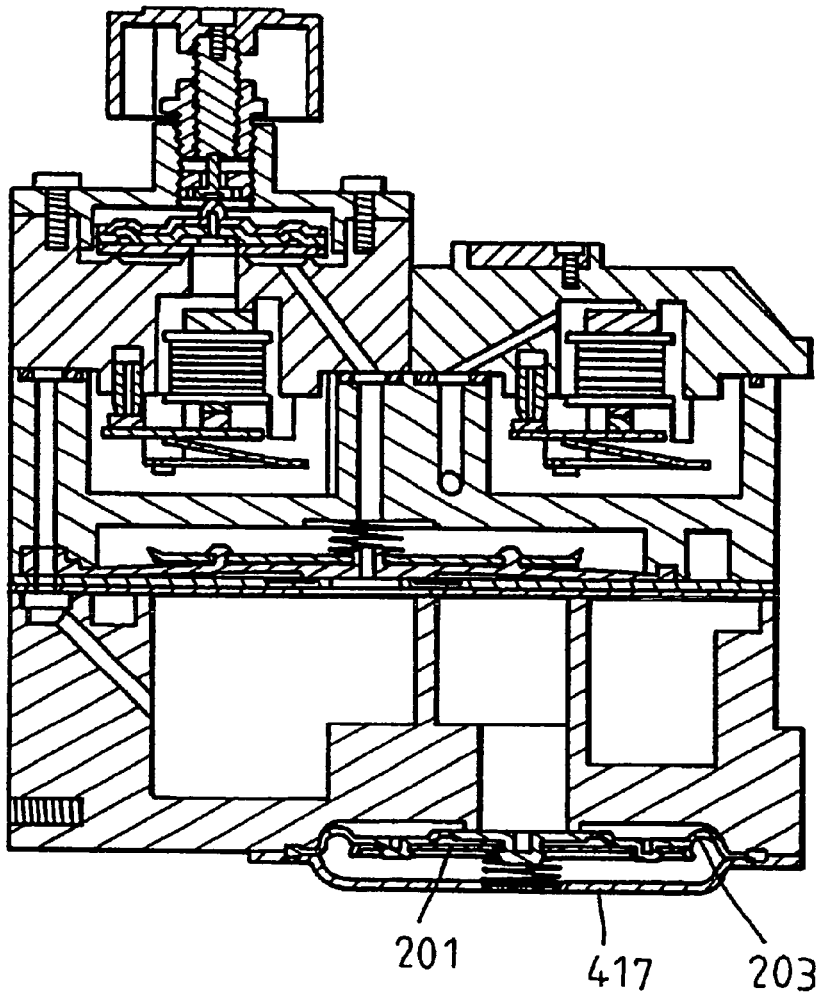
FIG. 5 is a front plan cross-sectional assembly view of the gas valve switch structure of a gas stove as shown in FIG. 1.
Figure 6:
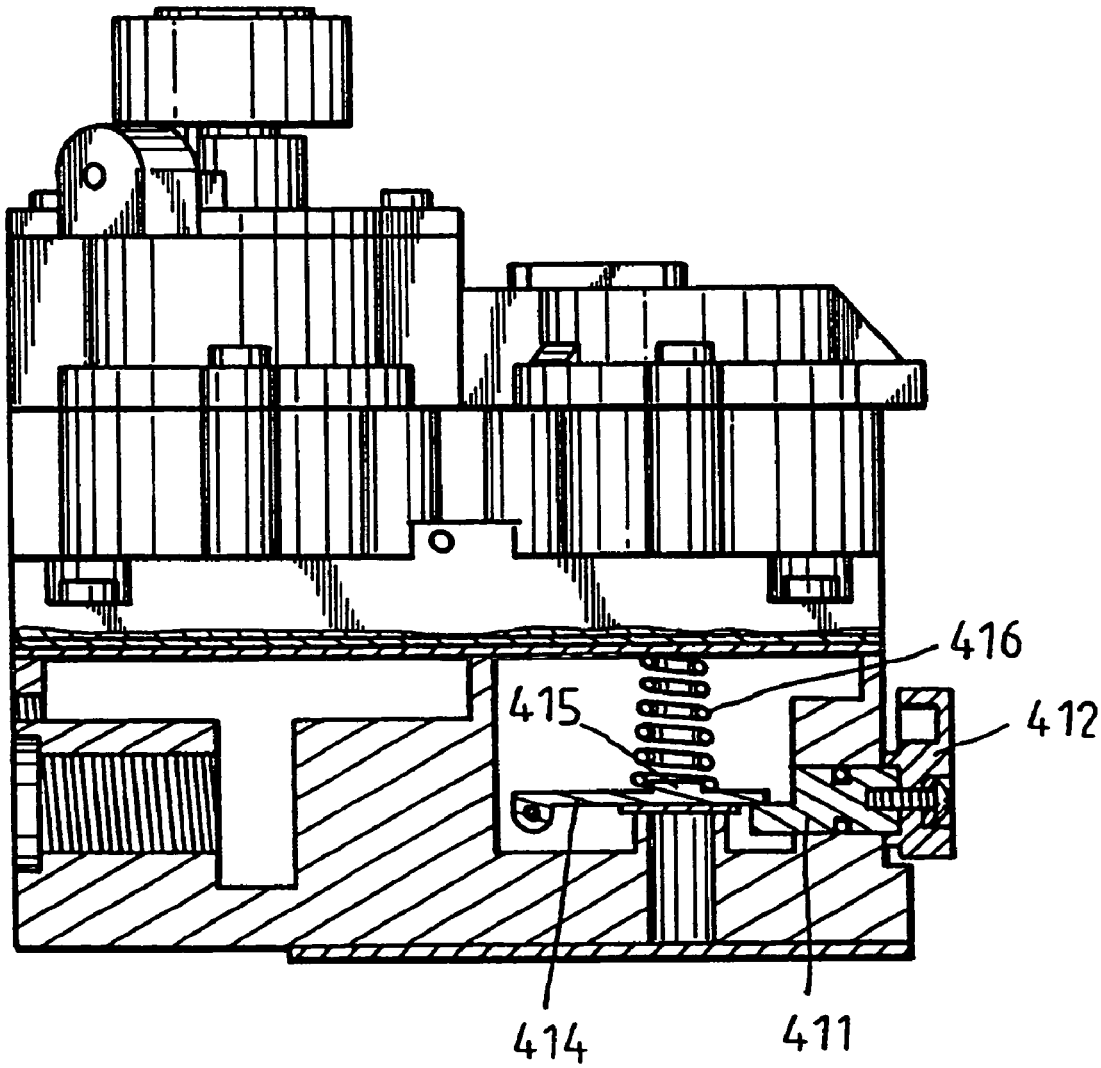
FIG. 6 is a front plan cross-sectional operational view of the gas valve switch structure of a gas stove as shown in FIG. 1.
Figure 7:
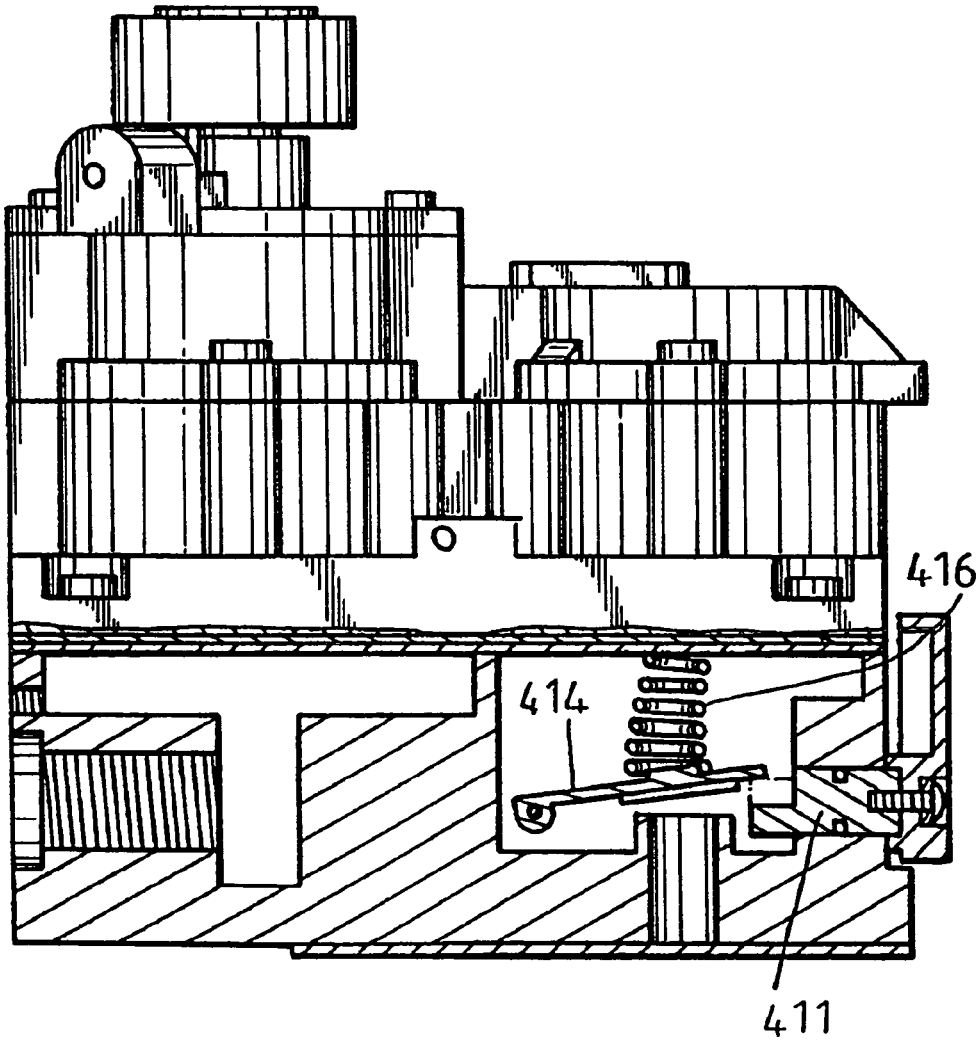
FIG. 7 is an operational view of the gas valve switch structure of a gas stove as shown in FIG. 6.
Figure 8:
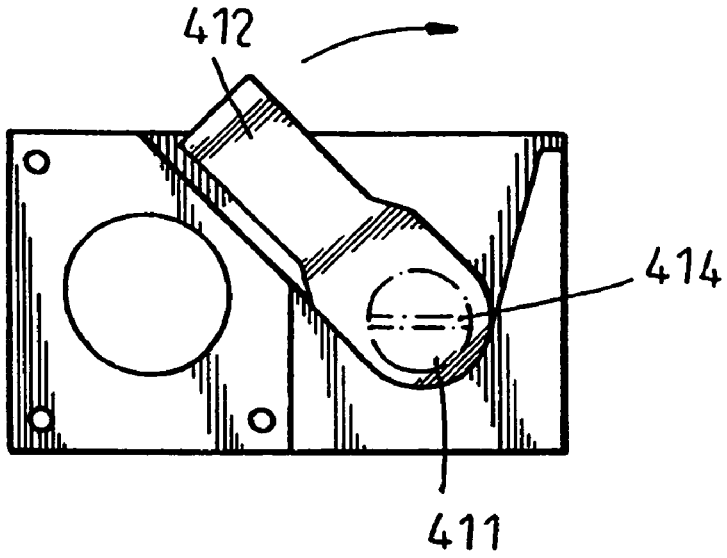
FIG. 8 is a side plan operational view of the gas valve switch structure of a gas stove as shown in FIG. 1.
Figure 9:
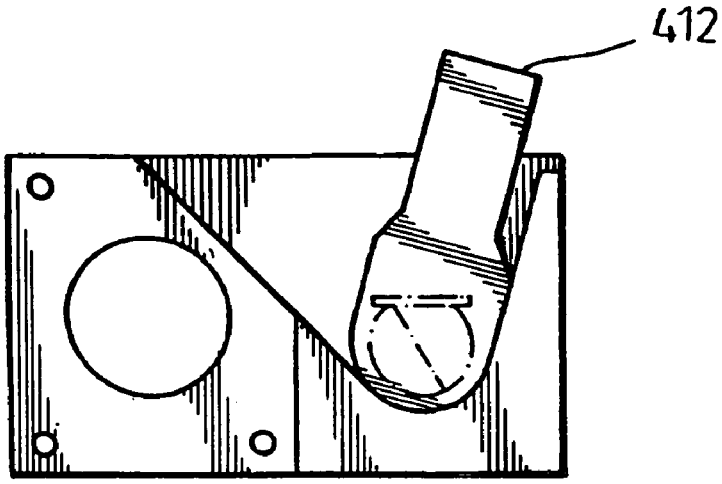
FIG. 9 is an operational view of the gas valve switch structure of a gas stove as shown in FIG. 8.

Referring to FIGS. 1–9, a gas valve switch structure of a gas stove in accordance with the present invention comprises a top base 100, an aluminum plate 300, a sealing washer 304, two rubber washers 203, two fixing pieces 201, a female base 400, and a protective plate 417.

The top base 100 is substantially rectangular and has a bottom defining an oblong hole 407. The oblong hole 407 has a bottom defining an air draining hole 419. The top base 100 has an upper end integrally defining two trough holes 104, and a pressure outlet hole 105 and a pressure inlet hole 106 located between the two through holes 104. The two through holes 104 are each respectively fitted with a female fire electromagnetic valve 102 and a main fire electromagnetic valve 101. The main fire electromagnetic valve 101 has its top provided with a pressure regulating knob 103, wherein the female fire electromagnetic valve 102 is used to control movement of the fixing piece 201 which is located above the female base 400, and the main fire electromagnetic valve 101 is used to control movement of the fixing piece 201 which is located under the top base 100. The pressure outlet hole 105 and the pressure inlet hole 106 are each respectively screwed with a bolt 107.

The aluminum plate 300 is a rectangular piece, and has a center defining an air draining hole 301. The air draining hole 301 has one side defining a rectangular hole 302, and a plurality of circular holes 303.

The sealing washer 304 is a rectangular piece, and has a center defining an air draining hole 301. The air draining hole 301 has one side defining a rectangular hole 302, and a plurality of circular holes 303.

The rubber washer 203 is an oblong piece, and has a center integrally formed with a fixing bolt 204, and two ends each defining an air outlet hole 205, and a periphery defining a plurality of draining holes 206.

The fixing piece 201 is an oblong disk, and has a center defining a locking hole 202, and two ends each defining an air outlet hole 205.

The female base 400 is substantially rectangular, and has an inner portion integrally formed with a plurality rib walls for separating the inner portion into a first air storing chamber 408, a second air storing chamber 409, and a third air storing chamber 410. The female base 400 has one side defining a female fire air outlet hole 401 and a main fire air outlet hole 402, and the other side defining a fixing hole 405 and an air inlet hole 404, and has two ends each defining a side hole 403. The first air storing chamber 408 communicates with the air inlet hole 404. The inner portion of the female base 400 defines a channel 418 so that the second air storing chamber 409 communicates with the female fire air outlet hole 401. The female base 400 has a bottom defining an oblong hole 407. The oblong hole 407 has a bottom defining an air draining hole 419. A control bolt 411 passes through the fixing hole 405. The control bolt 411 has one end with a semi-cylindrical shape, and the other end fitted with a washer 413, and has a tail end screwed with a wrench 412. An air pressure valve 414 is secured in the first air storing chamber 408. The air pressure valve 414 is a piece having a center provided with a protruding knob 415, and the semi-cylindrical end of the control bolt 411 is rested on a lower end of the air pressure valve 414.

The protective plate 417 is substantially rectangular, and has a center defining an oblong hole 407. The oblong hole 407 has a center defining a circular recess 406.

In assembly, the oblong holes 407 of the top base 100 and the female base 400 each respectively receive a rubber washer 203. The fixing bolt 204 of the rubber washer 203 is fitted with a fixing piece 201. The fixing piece 201 defines a circular recess 202 for receiving a spring 200, so that the fixing piece 201 may be displaced on the fixing bolt 204. Then, the protective plate 417 is used for sealing the rubber washer 203 and the fixing piece 201 in the oblong hole 407 of the female base 400. Then, the top base 100 is screwed on a top of the female base 400, with the aluminum plate 300 and the sealing washer 304 being clamped between the top base 100 and the female base 400. The plurality of air storing chambers of the female base 400 are closed while the rubber washer 203 and the fixing piece 201 of the top base 100 are sealed in the oblong hole 407 of the female base 400 by provision of the aluminum plate 300 and the sealing washer 304. The gas valve switch structure of the gas stove achieves a gas triple safety switch by provision of the two electromagnetic valves and the control bolt.

It should be clear to those skilled in the art that further embodiments may be made without departing from the scope of the present invention.

What is claimed is:

1. A gas valve, comprising:

a first base member having opposing first and second sides and including at least first, second and third storing chambers, first and second outlet openings, and an inlet opening, the first storing chamber being in communication with the inlet opening, the second storing chamber being in communication with the first outlet opening, and the third storing chamber being in fluid communication with the second outlet opening;

a second base member coupled to the second side of the first base member and including first and second valve bores, a pressure inlet hole, and a pressure outlet hole;

first and second electromagnetic valves mounted in the first and second valve bores of the second base member;

a first adjustable member positioned adjacent to the first side of the first base member and configured to be controlled by the first electromagnetic valve to control fluid flow between the first storing chamber and the second storing chamber; and a second adjustable member positioned between the second side of the first base member and the second base member and configured to be controlled by the second electromagnetic valve to control fluid flow between the first storing chamber and the third storing chamber.

2. The valve of claim 1, wherein the first adjustable member includes a first fixing member and a first washer coupled to the first fixing member.

3. The valve of claim 2, wherein the second adjustable member includes a second fixing member and a second washer coupled to the second fixing member.

4. The valve of claim 2, further comprising a first plate structure positioned adjacent to the first fixing member to sealably retain the first adjustable member to the first base member.

5. The valve of claim 4, further comprising a second plate structure positioned between the first base member second side and the second adjustable member.

6. The valve of claim 1, further comprising an air pressure valve positioned in the first base member and movable between open and closed positions.

7. The valve of claim 6, further comprising an actuating member mounted to the first base member and configured to actuate the air pressure valve.

8. The valve of claim 1, wherein the pressure inlet hole and the pressure outlet hole each include an opening that extends through the second base member, and the valve further includes first and second pressure adjustment bolts movable within respective pressure inlet and outlet holes.

9. The valve of claim 5, wherein the second plate structure includes a plurality of holes in fluid communication with the pressure inlet and outlet holes.

10. The valve of claim 1, wherein the second electromagnetic valve includes a pressure regulating knob.

11. The valve of claim 2, wherein the second adjustable member includes a plurality of holes in fluid communication with the pressure inlet and outlet holes.

12. A gas valve, comprising:

a first base member having opposing first and second sides and including first and second outlet openings, and an inlet opening;

a second base member coupled to the second side of the first base member and including first and second valve bores;

first and second electromagnetic valves mounted in respective first and second valve bores of the second base member;

a first adjustable member positioned adjacent to the first side of the first base member and configured to be controlled by the first electromagnetic valve to control fluid flow between the inlet opening and the first outlet opening; and a second adjustable member positioned between the second side of the first base member and the second base member and configured to be controlled by the second electromagnetic valve to control fluid flow between the inlet opening and the second outlet opening.

13. The valve of claim 12, wherein the first base member further includes at least first, second and third storing chambers, the first storing chamber being in communication with the inlet opening, the second storing chamber being in communication with the first outlet opening, and the third storing chamber being in fluid communication with the second outlet opening, the first adjustable member being configured to control fluid flow between the first and second storing chamber, and the second adjustable member being configured to control fluid flow between the first and third storing chambers.

14. The valve of claim 12, wherein the second base member further includes a pressure inlet hole and a pressure outlet hole.

15. The valve of claim 12, wherein the first adjustable member includes a first fixing member and a first washer coupled to the first fixing member.

16. The valve of claim 15, wherein the second adjustable member includes a second fixing member and a second washer coupled to the second fixing member.

17. The valve of claim 15, further comprising a first plate structure positioned adjacent to the first fixing member to sealably retain the first adjustable member to the first base member.

18. The valve of claim 17, further comprising a second plate structure positioned between the first base member second side and the second adjustable member.

19. The valve of claim 12, further comprising an air pressure valve positioned in the first base member and movable between open and closed positions.

20. The valve of claim 19, further comprising an actuating member mounted to the first base member and configured to actuate the air pressure valve.

21. The valve of claim 14, wherein the pressure inlet hole and the pressure outlet hole each include an opening that extends through the second base member, and the valve further includes first and second pressure adjustment bolts movable within respective pressure inlet and outlet holes.

22. The valve of claim 18, wherein the second plate structure includes a plurality of holes in fluid communication with the inlet and outlet openings.

23. The valve of claim 12, wherein the second electromagnetic valve includes a pressure regulating knob.

24. The valve of claim 14, wherein the second adjustable member includes a plurality of holes in fluid communication with the pressure inlet and outlet holes.

* * * * *